US005659865A

United States Patent [19]

Zarbo

[11] Patent Number: 5,659,865

[45] Date of Patent: Aug. 19, 1997

[54] PRESSURE ROLLER CLEANING BLADE

[75] Inventor: Ronald O. Zarbo, Pavilion, N.Y.

[73] Assignee: Eastman Kodak Company, Rochester, N.Y.

[21] Appl. No.: 635,144

[22] Filed: Apr. 19, 1996

[51] Int. Cl.[6] ..... G03G 15/20; G03G 21/00

[52] U.S. Cl. ..... 399/327; 399/351

[58] Field of Search ..... 355/283, 284, 355/290, 296, 299; 219/216; 432/60; 15/256.51; 118/60, 101, 261

[56] References Cited

U.S. PATENT DOCUMENTS

| | | | |
|---|---|---|---|
| 4,165,965 | 8/1979 | Bernardelli et al. | 432/75 |
| 4,821,064 | 4/1989 | Mills et al. | 355/315 |
| 5,493,375 | 2/1996 | Moser | 355/283 |

*Primary Examiner*—Matthew S. Smith
*Assistant Examiner*—Sophia S. Chen
*Attorney, Agent, or Firm*—Lawrence P. Kessler

[57] ABSTRACT

In a reproduction apparatus including a fusing assembly for fixing a marking particle developed image to a receiver member, wherein a release liquid is applied to the fusing assembly to prevent marking particles of such image from adhering thereto, a mechanism for cleaning the assembly. The cleaning mechanism includes a blade member having an elongated body with an edge surface adapted to be located in scraping engagement with a portion of the fusing assembly. A housing assembly is provided for retaining the blade member, the end portions of the elongated body of the blade member extending further from the housing assembly than the central portion of the elongated body of the blade member by at least one spacer. The housing assembly is supported relative to the fusing assembly such that substantially the entire edge surface of the body of the blade member contacts the portion of the fusing assembly, with the end portions oriented to direct release liquid toward the central portion of the blade member elongated body.

13 Claims, 4 Drawing Sheets

PRESSURE ROLLER CLEANING BLADE

BACKGROUND OF THE INVENTION

The present invention relates in general to cleaning of a pressure roller for an electrostatographic reproduction apparatus fusing assembly, and more particularly to a particularly shaped blade for cleaning the pressure roller of a fusing assembly.

In typical commercial electrostatographic reproduction apparatus (copier/duplicators, printers, or the like), a latent image charge pattern is formed on a uniformly charged charge-retentive or photoconductive member having dielectric characteristics (hereinafter referred to as the dielectric member). Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member, and the image is fixed (fused) to the receiver member by heat and pressure to form a permanent reproduction thereon.

The fixing process is typically carried out by passing a receiver member, bearing a marking particle developed image, through a fusing assembly including a nip roller pair. At least one of the rollers of the nip roller pair is heated to cause the marking particles to soften and become tacky. The rollers are urged into a predetermined pressure relation so as to force the softened marking particles to the receiver member. For example, for a paper receiver member, the marking particles are forced into the interstices of the paper fibers and become imbibed therein so that on cooling the image is fixed (fused) to the paper receiver member.

In the fusing assembly of the above described type, it has been found that the marking particles generally have an affinity for the nip rollers. Since the particles would thus tend to stick to the rollers and cause unacceptable artifacts in reproductions, a release liquid is applied to the rollers to inhibit the ability of the particles to stick to the rollers, and encourage their adherence to the receiver member. For example, a typical release liquid is silicone oil. The release liquid tends to accumulate on the rollers towards the outboard ends. This is due to the fact that release liquid is provided so as to cover the roller surface over the area contacted by the widest receiver member to be handled by the fusing assembly. Since receiver members tend to absorb release liquid and remove it from the rollers, for receiver members of less width than the maximum, liquid is left on the rollers adjacent to the outboard ends (i.e., the area not contacted by the narrower receiver members). This excess release liquid then becomes a contaminant within the reproduction apparatus.

The harsh environment of the fusing assembly (i.e., the combination of the release liquid along with the heat and pressure) has been found to cause undue build-up on the rollers of residue such as paper dust or marking particles for example. One mechanism for preventing residue build-up on the fixing assembly rollers is to provide a cleaning blade in association with a roller. The engagement of the cleaning with the roller causes the blade to effectively scrape the surface of the associated roller and chisel off contaminates such as paper dust and/or marking particle residue. However the blade also has a tendency to skive off the excess release liquid. As a result, the liquid tends to accumulate along the blade as puddles which may cause deterioration of the roller, and will eventually roll off the ends of the blade into the reproduction apparatus and contaminate other parts of the apparatus. U.S. Pat. No. 5,493,375 (issued Feb. 20, 1996, in the name of Moser) describes a blade constructed to urge release liquid toward the outboard end of a fusing assembly roller and collect such liquid. This of course, necessitates additional structural elements which increase the complexity and expense of the reproduction apparatus.

SUMMARY OF THE INVENTION

In view of the foregoing discussion, this invention is directed to a cleaning mechanism, including a particularly shaped blade associated with a reproduction apparatus fusing assembly, for cleaning at least a portion of the fusing assembly while substantially preventing contamination of the reproduction apparatus due to roll off of release liquid. The cleaning mechanism includes a blade member having an elongated body with an edge surface adapted to be located in scraping engagement with a portion of the fusing assembly. A housing assembly is provided for retaining the blade member, the end portions of the elongated body of the blade member extending further from the housing assembly than the central portion of the elongated body of the blade member. The housing assembly is supported relative to the fusing assembly such that substantially the entire edge surface of the body of the blade member contacts the portion of the fusing assembly, with the end portions oriented to direct release liquid toward the central portion of the blade member elongated body.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
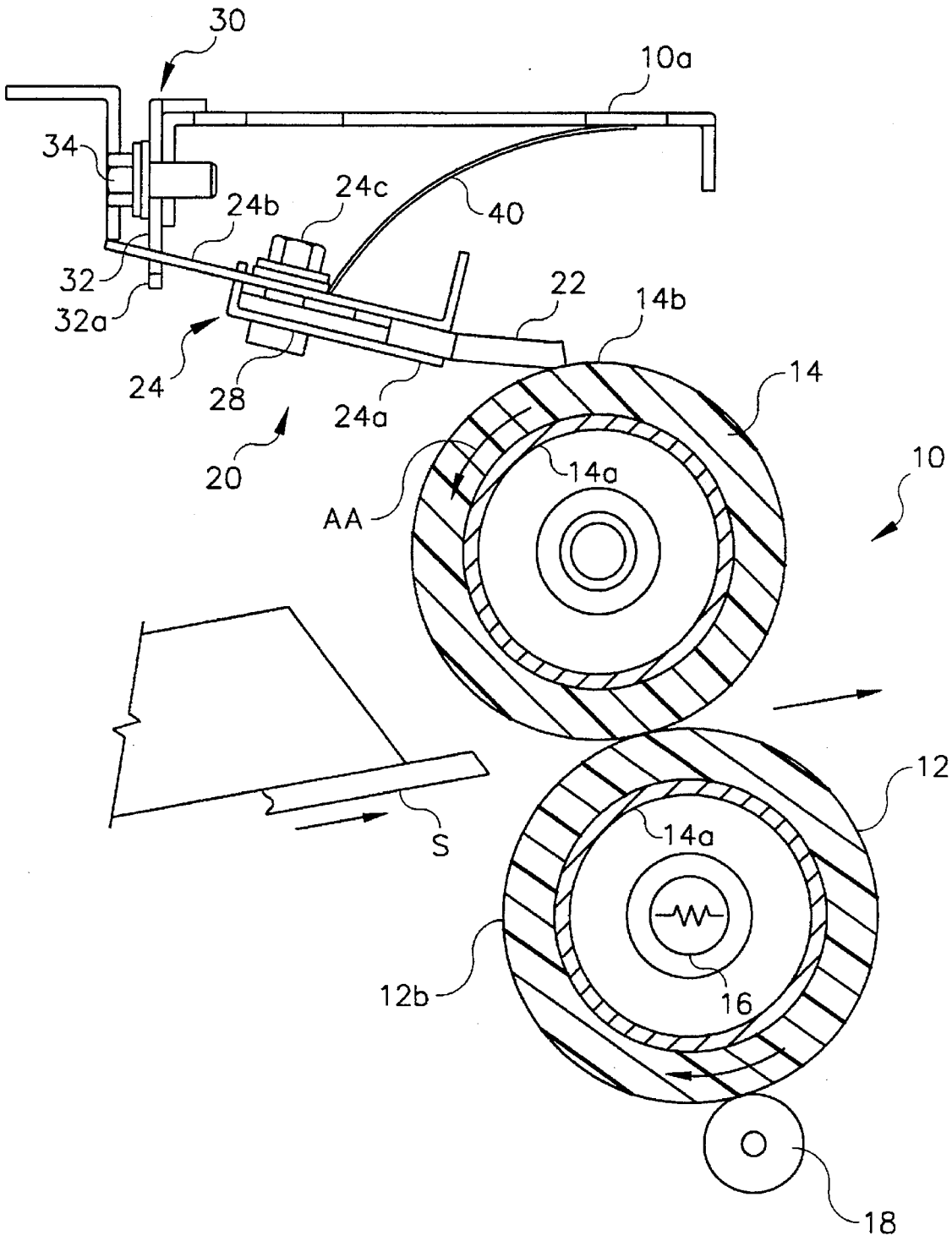
FIG. 1 is a side elevational view, partly in cross-section, of a reproduction apparatus fusing assembly, including a blade cleaner according to this invention, with portions removed to facilitate viewing.

Referring now to the accompanying drawings, FIG. 1 shows a reproduction apparatus fusing assembly, designated generally by the numeral 10. The fusing assembly 10 may be of any well known configuration for applying heat and/or pressure to a receiver member (e.g., sheet S), bearing a pigmented marking particle image, to fix the marking particle image to the receiver member to for a reproduction copy. An exemplary fusing assembly 10 includes a fusing roller 12 and a pressure roller 14, which are urged together to form a pressure nip therebetween. The fusing roller 12 is constructed, for example, with a metal (e.g. aluminum) core 12*a* having a silicone rubber surface overcoat 12*b*. An internal lamp 16 serves to provide the necessary energy to heat up the surface 12*b* to a temperature sufficient to plastisize the image-wise formation of pigmented marking particles on a receiver member (e.g., sheet S in FIG. 1) transported through the pressure nip between the rollers 12 and 14. The pressure roller 14 also has a metal core 14*a*, and may be covered with a thin layer 14*b* of a material having good release characteristics relative to the composition of the marking particles.

In order to prevent offset of the marking particles onto the surface of the roller 12, an offset preventing (release) liquid is applied to the surface of the roller 12 by a wicking device 18. The wicking device 18, of any well known construction, applies the release liquid over the surface of the roller sufficient, in the cross track direction (along the longitudinal axis of the roller), to cover the area of the roller contacted by the widest receiver member to be acted upon by the fusing assembly 10. During the time when a receiver member is absent from between the rollers 12 and 14 forming the pressure nip (e.g., between successive reproduction copies), release liquid transfers from the roller 12 to the roller 14.

In general, the amount of release liquid applied to the roller 12 is selected to be approximately equal to the amount of release liquid carried from the roller surface by a receiver member passing through the pressure nip during the fusing operation. However, since the more typical size receiver members are substantially narrower (in the cross-track direction) than the aforementioned widest receiver members to be handled by the fusing assembly 10, release liquid in the outboard areas of the roller is not removed by the receiver members and tends to build up over such areas. The accumulating release liquid in the outboard areas is transferred to the roller 14, where it likewise tends to build up to undesirable levels. As noted above release liquid build-up is a source of contamination which promotes collection of dust and debris, and can deteriorate portions of the fusing assembly 10 or other areas of the reproduction apparatus with which it comes in contact, such as when the release liquid drips from the rollers.

Accordingly, a cleaning blade assembly, according to this invention, is provided to clean the surface of a roller of the fusing assembly 10, and direct release liquid away from the outboard ends of such roller toward an area where it can be carried off by a receiver member being acted on by the pressure nip of the fusing assembly. The cleaning blade assembly, designated generally by the numeral 20, includes an elongated blade member 22 retained in a housing 24. The blade member 22 is made, for example, from a fluorocarbon rubber material which exhibits good wear resistance characteristics, and is not adversely effected by the release liquid. A typical material for the blade member 22 is referred to by the name trade name Viton.

Figure 3:
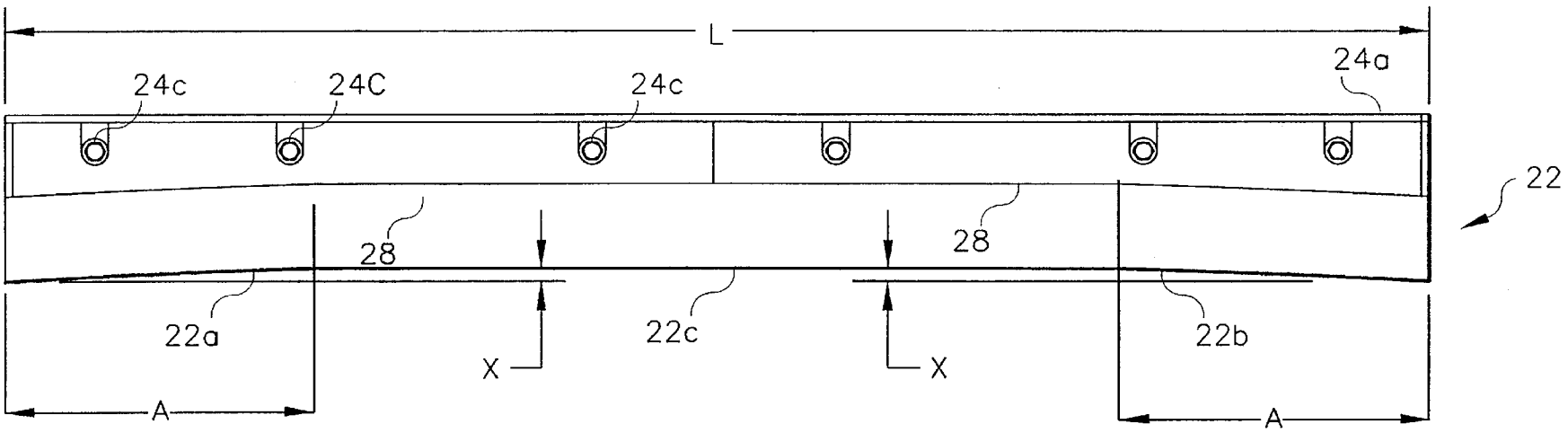
FIG. 3 is a top plan view of a portion of the blade cleaner according to this invention, particularly showing the spacers for configuring the cleaning blade.
Figure 4:
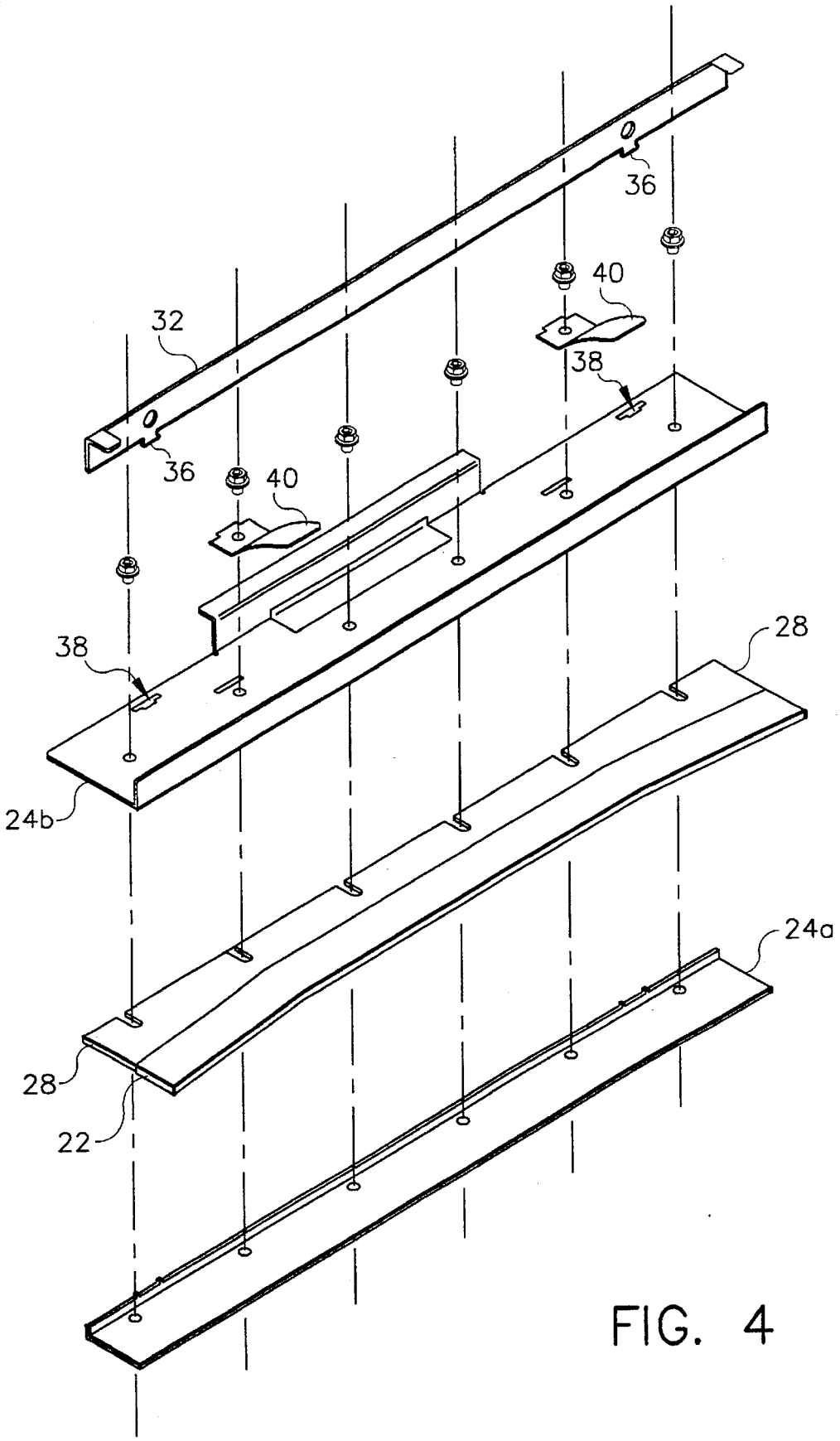
FIG. 4 is an exploded view, in perspective, of the blade cleaner according to this invention.

The housing 24 for retaining the blade member 22 is generally of a U-shaped cross-section, capturing the blade member between a clamping piece 24*a* and a blade holder 24*b*. The clamping piece 24*a* and the blade holder 24*b* are secured together, capturing the blade member 22, by any suitable fastener elements, such as nut-and-bolts 24*c* for example (see FIG. 4). A plurality of spacers 28 are contained within the housing 24. The spacers 28 are shaped (see FIG. 3) so as to cause the blade member 22, of an overall length L in the cross-track direction, to assume a configuration where the end portions 22*a*, 22*b*, of a length A, of the blade member extend outwardly from the housing 24 from the central portion 22*c* thereof to a maximum distance X at the outermost ends. Of course, other types of spacers, such as shims or angle members for example, are suitable for use with this invention.

In the particular illustrated embodiment, the overall length L of the blade member 22 is approximately 38 cm. Further, the spacers 28 cause the length A to extend over approximately 10–25% of each end of the blade member, with the distance X, representing the maximum outward extension of the respective end portions 22*a*, 22*b* from the central portion 22*c*, being in the range of 0.20–0.30 cm. Preferably, the respective lengths A are 8.82 cm, and the distances X are 0.30 cm.

Figure 5:
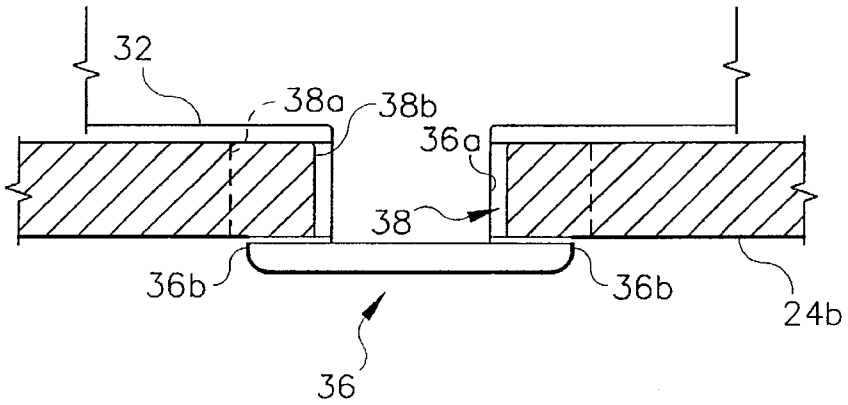
FIG. 5 is a front elevational view, partly in cross-section and on an enlarged scale, of the locking tabs of the hanger for the blade of the blade cleaner according to this invention.

The housing 24 for retaining the cleaning blade member 22 is supported, in the reproduction apparatus, relative to the roller 14 of the fusing assembly 10, by a hanger 30. The hanger 30 includes a bracket 32 attached to a portion 10*a* of the frame of the fusing assembly 10 by any suitable fastener elements, such as bolts 34 for example. The bracket 32 has a plurality of tabs 36 extending therefrom. The blade holder 24*b* defines a plurality of notches 38 for receiving the plurality of tabs 36 respectively (see FIGS. 4 and 5).

In order to connect and lock the housing 24 retaining the blade member 22 to the hanger 30 for support thereon, the tabs 36 each have a neck portion 36*a* and a pair of outboard locking features 36*b*. Further, the notches 38 are each configured to have a wide portion 38*a* and a narrower portion 38*b*. The size of the wide portion 38*a* is selected to receive the tab 36 including the outboard locking features 36*b*, while the narrower portion 38*b* will only accommodate the neck portion 36*a* of the tab. In this manner, the locking features of a tab can be inserted completely through the wide portion of an associated notch, and when the holder 24*b* is moved in a direction perpendicular to the plane containing the hanger 30, the tab neck portion 36*a* is accommodated in the narrower portion 38*b* of the notch. The blade holder 24*b* (and thus the housing 24 and the retained blade member 22) will thus be "locked" on the hanger 30 by the engagement of the locking features 36*b* of each tab 36 with the mating surface of the blade holder adjacent to the respective narrower portions 38*b* of the associated notches. Of course, other well known mechanical arrangements, suitable for use with this invention, may be provided for connecting the housing 24 to the hanger 30.

The blade holder 24*b* also supports a plurality of urging members attached thereto by any suitable fastener elements. In the illustrated embodiment, the urging members are leaf springs 40 attached to the holder 24*b* by selected nuts-and-bolts 24*c* (used to secure the blade holder to the clamping piece 24*a*). The leaf springs 40 are adapted to engage the portion 10*a* of the fusing assembly 10 as shown in FIG. 1. As such, the leaf springs provide a selected force on the housing 24. The force on the housing 24 urges the blade holder 24*b* in a first direction (substantially perpendicular to the hanger 30) to provide the locking action of the tabs 36 in the respective notches 38, and in a second direction (normal to the surface of the roller 14) to position the peripheral edge surface of the blade member 22 in operative relation with the roller 14. Due to the fact that the outboard portions 22*a* and 22*b* of the blade member 22 extend further from the housing 24 than the central portion 22*c*, when the blade is properly engaged with the roller 14 under the urging of the leaf springs 40, the blade member will take on a curved configuration, relative to the roller surface, as best seen in FIG. 2.

Figure 2:
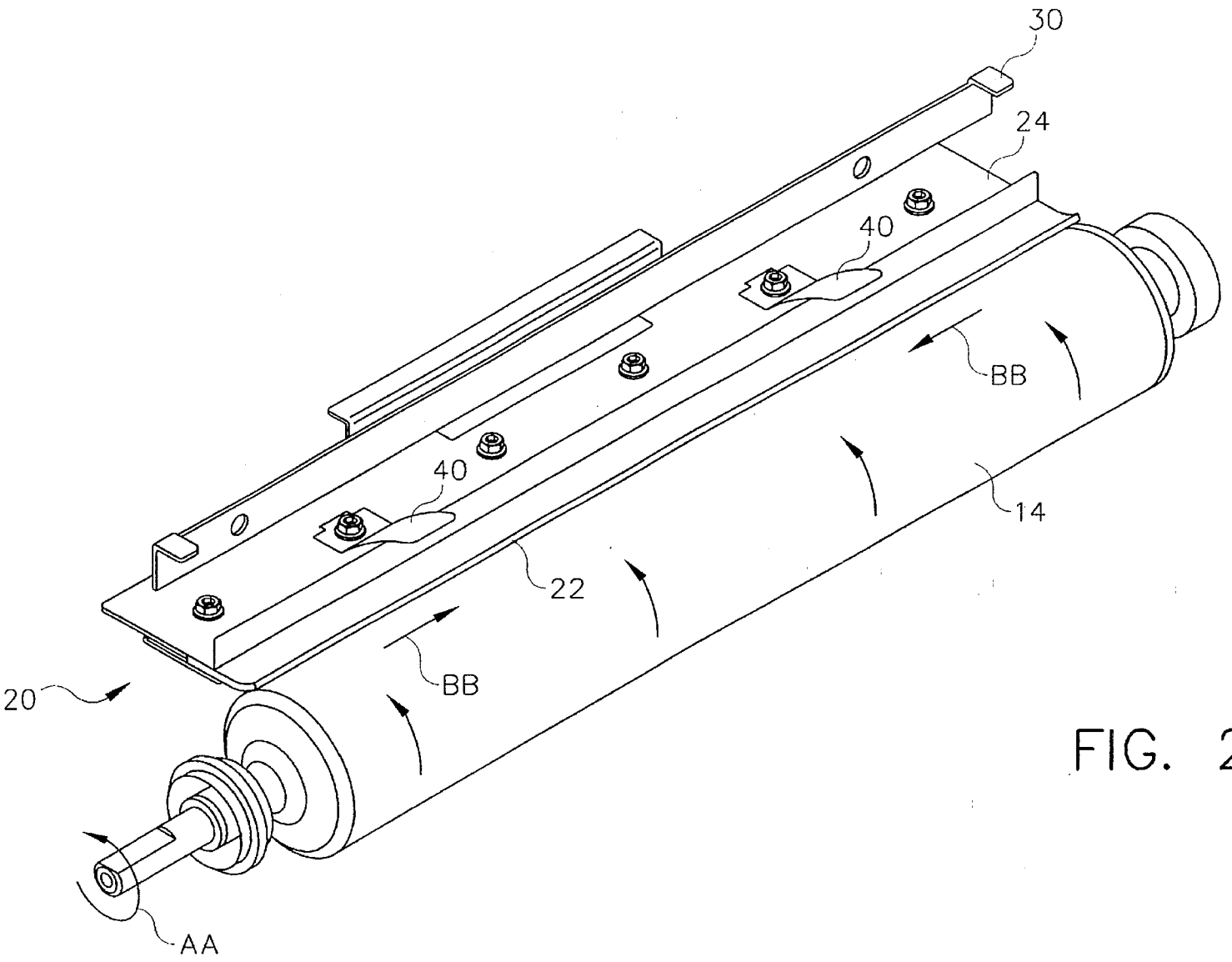
FIG. 2 is a view, in perspective, of the blade cleaner, associated with a fusing assembly roller, according to this invention, showing the particular engagement between the roller and the blade cleaner so as to cause the release liquid to flow, relative to the longitudinal axis of the roller, toward the center of the roller.

With the above described arrangement, the blade member 22 of the blade cleaning mechanism 20 according to this invention will scrape the surface of the roller 14 as the roller rotates in the direction indicated by arrows AA in FIGS. 1 and 2. Such scraping action removes contaminates from the roller surface. Moreover, according to this invention, the curved configuration of the blade member 22 relative to the roller 14 causes release liquid to be moved (in the direction of arrows BB of FIG. 2) from the outboard areas of the roller in the longitudinal direction toward the center thereof. In the central location, the release liquid can be readily removed by receiver members being acted upon in the pressure nip between the rollers 12 and 14. Accordingly, the undesirable (and potentially damaging) build up of excess release liquid in the outboard areas of the roller 14 is prevented.

The invention has been described in detail with particular reference to a preferred embodiment thereof, but it will be understood that variations and modifications can be effected within the spirit and scope of the invention as set forth in the claims.

What is claimed is:

1. In a reproduction apparatus including a fusing assembly for fixing a marking particle developed image to a receiver member, wherein a release liquid is applied to at least a portion of said fusing assembly to prevent marking particles of such image from adhering to said fusing assembly, means for cleaning said fusing assembly, said cleaning means comprising:

a blade member having an elongated body with an edge surface adapted to be located in scraping engagement with said portion of said fusing assembly to which release liquid is applied;

a housing for retaining said blade member, said housing including at least one spacer for extending the end portions of said elongated body of said blade member further from said housing than the central portion of said elongated body of said blade member; and means for supporting said housing relative to said portion of said fusing assembly such that substantially the entire edge surface of said elongated body of said blade member contacts said portion of said fusing assembly, with the end portions oriented to direct release liquid toward the central portion of the blade member elongated body.

2. The cleaning means according to claim 1 wherein said at least one spacer causes said end portions of said blade to extend over approximately 10–25% of the length of said blade.

3. The cleaning means according to claim 2 wherein said blade extends over 8.82 cm of a blade of an overall length of 38 cm.

4. The cleaning means according to claim 2 wherein said at least one spacer causes said end portions of said blade to extend to a maximum distance in the range of approximately 0.20–0.40 cm.

5. The cleaning means according to claim 4 wherein said at least one spacer causes said end portions of said blade to extend to a maximum distance of 0.30 cm.

6. The cleaning means according to claim 1 wherein said means for supporting said housing includes a spring urging said blade into operative relation with said fusing assembly.

7. The cleaning means according to claim 6 wherein said means for supporting said housing further includes a hanger mounted on said fusing assembly, said hanger having a plurality of tabs receivable respectively in a plurality of slots defined in said housing.

8. A fusing assembly for a reproduction apparatus, said fusing assembly comprising:

at least one roller, for applying pressure to a receiver member bearing a marking particle developed image for fixing such image to said receiver member;

means for applying a release liquid to said roller to prevent marking particles of such image from adhering to said roller;

a roller cleaning blade member having an elongated body with an edge surface adapted to be located in scraping engagement with said fusing assembly roller;

a housing for retaining said blade member, said housing including at least one spacer for extending the end portions of said elongated body of said blade member over approximately 10–25% of the overall length of said blade further from said housing than the central portion of said elongated body; and means for supporting said housing relative to said fusing assembly roller such that substantially the entire edge surface of said elongated body of said blade member contacts said roller, with the end portions oriented to direct release liquid toward the central portion of the blade member elongated body.

9. The cleaning means according to claim 8 wherein said blade extends over 8.82 cm of a blade of an overall length of 38 cm.

10. The cleaning means according to claim 8 wherein said at least one spacer causes said end portions of said blade to extend to a maximum distance in the range of approximately 0.20–0.40 cm.

11. The cleaning means according to claim 10 wherein said at least one spacer causes said end portions of said blade to extend to a maximum distance of 0.30 cm.

12. The cleaning means according to claim 8 wherein said means for supporting said housing includes a spring urging said blade into operative relation with said fusing assembly.

13. The cleaning means according to claim 12 wherein said means for supporting said housing further includes a hanger mounted on said fusing assembly, said hanger having a plurality of tabs receivable respectively in a plurality of slots defined in said housing.

* * * * *